United States Patent [19]

Henze et al.

[11] Patent Number: 4,993,334

[45] Date of Patent: Feb. 19, 1991

[54] SEWING STATION FOR PIECES OF MATERIAL

[76] Inventors: Siegfried Henze, Raiffeisenstr. 10, D-8741 Hohenroth; Hubert Kaluza, Hauptstr. 45, D-8732 Kleinwenkheim, both of Fed. Rep. of Germany

[21] Appl. No.: 358,267

[22] Filed: May 30, 1989

[30] Foreign Application Priority Data

Jun. 3, 1988 [DE] Fed. Rep. of Germany ..... 3818796

[51] Int. Cl.[5] ..... D05B 21/00

[52] U.S. Cl. ..... 112/121.12; 112/306; 271/227

[58] Field of Search ..... 112/121.12, 153, 306, 112/121.11, 121.15; 271/227, 243

[56] References Cited

U.S. PATENT DOCUMENTS

| | | | |
|---|---|---|---|
| 3,897,945 | 8/1975 | Faltot et al. | 271/227 |
| 4,607,582 | 8/1986 | Brocklehurst | 112/121.12 |
| 4,608,936 | 9/1986 | Ball et al. | 112/153 X |
| 4,754,717 | 7/1988 | Henze et al. | 112/306 X |

*Primary Examiner*—Werner H. Schroeder
*Assistant Examiner*—Paul C. Lewis
*Attorney, Agent, or Firm*—Laubscher, Presta & Laubscher

[57] ABSTRACT

In a sewing station, an alignment device is provided in the delivery area from a first conveyance device to a second conveyance device and, seen from the direction of movement of the piece of material, before a processing station. The alignment device has alignment strips which may be raised and lowered and which are also horizontally adjustable. The strips are controlled by sensing elements sensing the arrangement of the front edges of the pieces of material and placed on the piece of material. In accordance with the oblique position of the forward moving edge of the piece of material, the alignment strips are moved together with the piece of material in the direction of conveyance or counter to the direction of conveyance, and this continues until the oblique position of the forward moving edge is corrected or lies within the allowable tolerance. After such alignment, the second conveyance device conveys the piece of material to the processing station.

10 Claims, 8 Drawing Sheets

SEWING STATION FOR PIECES OF MATERIAL

BACKGROUND OF THE INVENTION

The present invention relates to a sewing station for pieces of material with processing stations, for instance for the hemming, trimming or the like, and with a first conveyance device for the pieces of material cut in lengths from a stock source, which delivers these pieces of material to a second conveyance device, which can be raised by means of a lifting device for introduction of the pieces of material and can be lowered for picking up the piece of material and for its further conveyance to at least one work station.

In such a sewing station, pieces of material receive and preserve certain tensions during their manufacture and finishing. It has particularly been proven that following the cutting of pieces of the material coming from a stock supply (uncut length of fabric) the pulled away materials, which generally are woven printed jacquard or have special patterns, must be straightened out, since otherwise subsequent processing of the piece of material can lead to defects, blemishes or obstructions. The tension in the piece of material indeed is modified following the cutting step and causes imprecisely definable oblique positioning of the piece of material. The result of this is that the forward moving or front edge of a piece of material, for instance in the case of hemming of the cut edges, no longer runs flush with the hems which are produced. The result is a defective piece of material.

In order to overcome the aforementioned imperfections, devices are already known (U.S. Pat. No. 3,906,878) which are integrated into the assembly for hemming the piece of material. These devices have endless transport arrangements which should provide alignment corresponding to the original alignment by modification of their rotary velocity. This method however has the drawback that stresses or tensions occur in the pieces of material during and at the same time as the formation of the hem, which subsequently can be modulated only with great difficulty. Correction of the positioning of the piece of material in this case is further complicated in that with the hemming procedure the material already must be guided exactly and securely, which condition however essentially prevents any subsequent position correction. Then when on the one hand the pieces of material are guided securely and without slippage, on the other hand the oblique positioning of the pieces of material can no longer be corrected. Now the hemming assembly is constructed so that the pieces of material can be subjected to correction of their oblique positioning even during the hemming procedure, which is possible only with less secure guiding and control of the pieces of material, and then too a uniform hem formation, especially with different qualities of material, can no longer be guaranteed in this case.

SUMMARY OF THE INVENTION

The object of the invention is to avoid the aforementioned difficulties and to further develop a sewing station of the aforementioned structural type so that the pieces of material are brought into position without any hindrances, as required for any processing, before reaching the processing station or stations.

This positioning is attained according to the invention in that in the area of the second conveyance device and in the direction of movement of the piece of material as considered before the processing station a device is provided which can be raised and lowered and is horizontally adjustable for alignment of the forward moving (front) edge of the border of the piece of material, which controls sensing elements sensing the arrangement of this edge of the piece of material and thus can be placed on a piece of material and according to the oblique positioning of the forward moving edge of the piece of material can be moved in the direction of or counter to the direction of conveyance of the piece of material while simultaneously gripping the same, until the oblique position of the forward moving edge of the piece of material is deleted or lies within the range of allowable tolerance, and that then the piece of material subsequently conveyed to the processing station by means of the second conveyance device. The alignment process takes place while the second conveyance device is raised. Then when the piece of material is removed from the second conveyance device for further conveyance to the relevant processing station, it has a suitable position with no obstacles present for the relevant processing and therefore can be guided precisely into the position and be processed following its introduction into the relevant processing station. Any subsequent correcting device, for instance in the hemming assembly, as is practiced in the present state of the art, is thus no longer necessary and is deleted. The oblique position of the forward moving edge of the piece of material can thus be measured for all practical purposes by any desired type of sensing elements, but photocells are preferred for this purpose.

Refinements of the invention are disclosed in the dependent claims. Thus it is claimed as advantageous that the alignment device be movable during an alignment procedure synchronously with the first conveyance device in the direction of conveyance. The sewing station can then advantageously continue working continuously (in other words even during the procedure of trimming or hemming the piece of material), which increases its high production rate correspondingly.

A structurally simple refinement of the invention, requiring relatively little mounting area, is characterized in that the alignment device has at least one alignment strip and is horizontally adjustable and can be placed on the piece of material adjacent to its edge which is to be processed parallel to the conveyance device for the piece of material. This alignment strip can be provided with a friction coating on its bottom edge which correspondingly increases the gripping effect.

According to still another embodiment of the invention the alignment strip can be mounted to be vertically movable on a carriage and can be raised and lowered by a lifting member, for instance a lifting cylinder, while this carriage can be moved back and forth by means of a power drive adjusting the final control of the setting along a stationary horizontal guide. This power drive for the adjustment of the final control of the setting is controlled by the sensing elements sensing the arrangement of the forward moving (front) edges of the pieces of material and then according to the results of the measurements is driven in one or the other direction, in order to move the alignment strip placed on the piece of material in the direction of or counter to the direction of conveyance of the relevant piece of material.

If according to still another embodiment of the invention also the power device adjusting the final control of the setting fastened to a carriage which is mounted on a stationary horizontal guide and can be moved in the direction of conveyance of the piece of material synchronously with the first conveyance device for the piece of material, then it is advantageous that the sewing station also continue to run during the alignment process.

A structural simplification and reliable synchronous movement of the alignment device with the first conveyance device is thus guaranteed in that the carriage carrying the power device adjusting the final control of the setting may be coupled to the first conveyance device for the pieces of material for synchronous movement with this device.

Another embodiment of the invention which enhances structural simplification is characterized in that the two carriages carrying the power device for adjusting the final control of the setting and the alignment strip are mounted on the same stationary horizontal guide.

Any oblique position of the forward moving edge of the piece of material can be measured and corrected simply in that the power device for adjustment of the final control of the setting intended for positioning of the alignment strip is controlled by means of two sensing elements, for instance photocells, which are arranged at some distance from one another, viewed from the direction of conveyance. The method of operation of the photocells for instance can then be such that when the correct position of the forward moving (front) edge of a piece of material is within the tolerance range one photocell is activated and the other photocell becomes inoperative. On the other hand, if both photocells either are activated or become inactive, then the alignment strip executes a correction procedure.

It is advantageous that the two sensing elements controlling the power device for adjusting the final control of the setting for the horizontal positioning of the alignment strip are fastened to the carriage carrying the power device for adjusting the final control of the setting.

Still another refinement of the invention is characterized in that also a sensing element controlling the coupling of the carriage carrying the power device for adjusting the final control of the setting relative to the conveyance device and the lowering of the alignment strip, for instance a photocell, is fastened to the carriage carrying the power device for adjusting the final control of the setting.

BRIEF DESCRIPTION OF THE DRAWINGS

The invention is explained in more detail hereinafter relative to the drawings of exemplary embodiments. In the drawings:

FIG. 6A shows a frontal view and different planar views of a part of a piece of material with a hem or the like;

DESCRIPTION OF THE PREFERRED EMBODIMENTS

Figure 1:
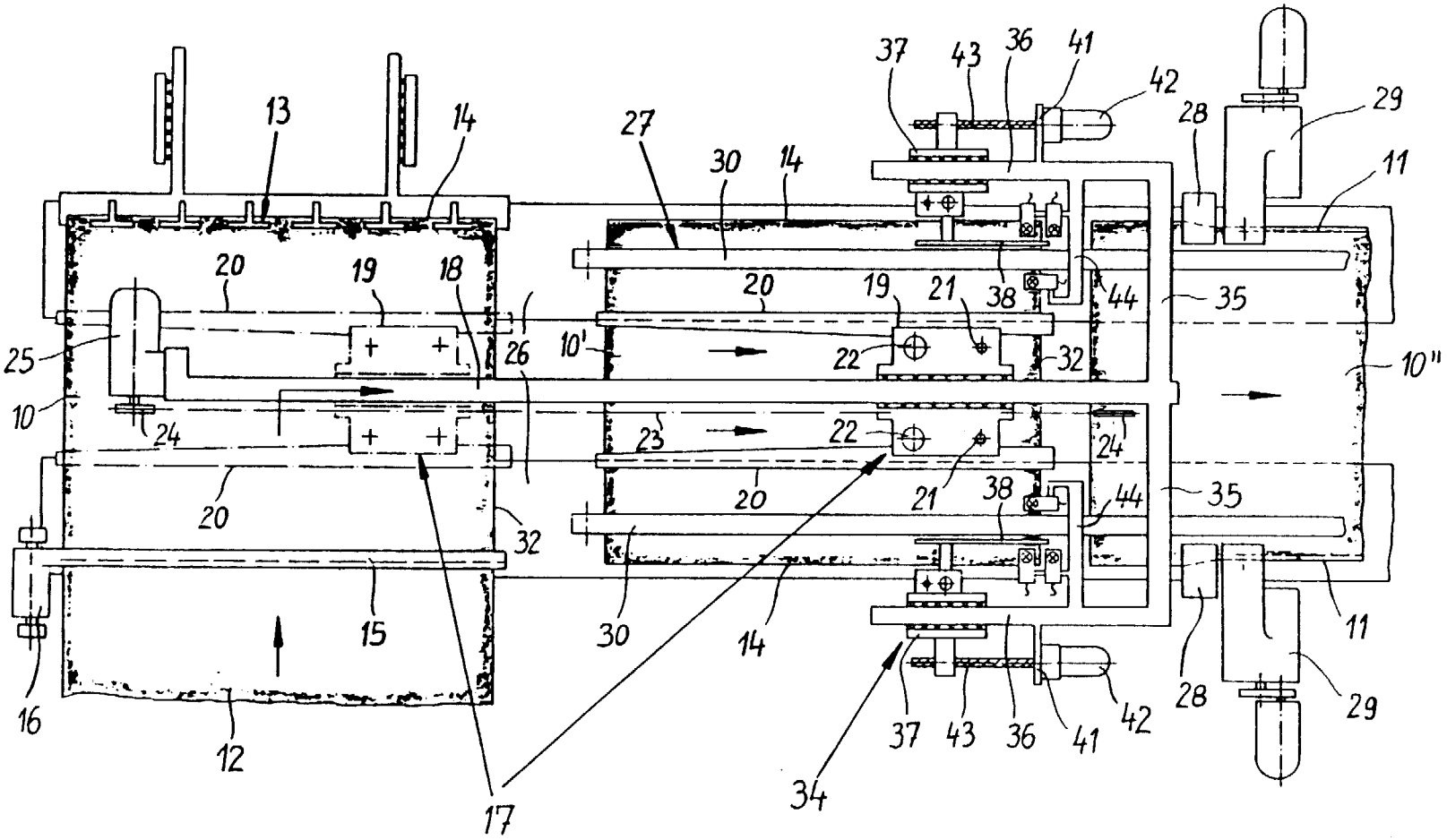
FIG. 1 is a planar view of the parts of a sewing station essentially for the present invention with a first and a second conveyance device and the alignment device according to the invention, arranged in mirror-inverted image relative to two edges of the piece of material facing one another and ready for processing, and indeed in an embodiment for a discontinuous method of operation.

In the sewing station shown only in part in FIG. 1, pieces of material 10, 10', 10'' and so forth are provided on two opposite edges with for instance a hem or border 11 on each edge. Other edge treatments applied to these edges of the pieces of material can also be carried out within the scope of the invention. Also, elastic strips could be sewn into each hem 11, for instance in order to produce fitted sheets. In the case of the pieces of material 10, 10', 10'' and so forth, it can also be a matter of a material serving for instance for the production of hand towels. An uncut section of fabric 12 serves as the original material source for the pieces of material 10, 10', 10'' and so forth, the original material drawn from a supply stack or delivery spool by means of a gripping device 13. Gripping device 13 is a unit or assembly which is known in such sewing stations, which needs no further explanation. Gripping device 13 picks up uncut piece of fabric 12 by one cut edge 14 and draws a desired length in the direction of the arrow, whereupon a cutting blade which is operable by a motor 16 is set in operation in order to sever a piece of material 10 from the uncut piece of material coming from the delivery spool or supply stack. Piece of material 10 is then picked up by a first conveyance device 17 to be carried in the direction of the arrow. Conveyance device 17 is shown in FIG. 1 on the left in dot-dash lines in its one edge position (starting position) and on the right in full lines in its other edge position (delivery position).

The first conveyance device 17 has a carriage 19 mounted on a guide bar 18, which carries two gripper strips 20. Guide bar 18 is mounted on the frame of the assembly (not shown) parallel to the conveyance device for pieces of material 10, 10', 10'' and so forth. Gripper strips 20 are mounted separately on each of two guide bars 21 and the piston rods of two lifting cylinders 22. These cylinders are then in turn mounted on the carriage 19, while guide rods 21 are mounted to be vertically movable on carriage 19. Furthermore, the two ends of a chain 23 are also fastened to carriage 19, wherein chain 23 runs over two sprocket wheels 24, of which the left sprocket wheel 24 as shown in FIG. 1 is driven alternately in either direction by a motor 25. The right sprocket wheel 24 is mounted to be freely rotatable on guide rod 18. Motor 25 is mounted on a part projecting from guide rod 18.

Gripper strips 20 have friction coating on their bottom surfaces and for the conveyance of pieces of material 10, 10' and so forth they are brought into contact with the pieces of material in the direction of the arrow by lifting cylinder 22, and actually are placed on the two facing edge areas of pieces of material 10, 10' and so forth, which rest on mounting plates 26. The two mounting plates 26 are fastened at some spacing from one another on either side and parallel to the direction of conveyance of pieces of material 10, 10' and so forth on the frame of the assembly.

Conveyance device 17 moves the piece of material 10 as shown in FIG. 1 to the right into a delivery position, which is indicated by 10' and in which the piece of material can be picked up by a second conveyance device 27. Along the two lengthwise edges of conveyance device 27 are arranged for instance a folding device 28 and a sewing machine 29 on each side and opposite one another. Folding devices 28, indicated only diagrammatically, serve for the formation of the hem or the like 11, while sewing machines 29 sew said hems or the like 11 (cf. also FIG. 6*a*).

The second conveyance device 27 has two endless conveyor belts 30, which are guided over not shown rollers, and one pair of rollers forms the drive rollers for conveyor belts 30, which for this purpose are mounted on a motor-powered shaft. Gripper strips 20 of the first conveyance device 17 are arranged so that they can enter the space between the two conveyor belts 30 of second conveyance device 27, in order to bring the piece of material 10 into receiving position for the second conveyance device 27, which is indicated with 10' in FIG. 1. For the purpose of picking up the piece of material 10, conveyor belts 30 of the second conveyance device 27 may be raised by a lifting device 31 (FIGS. 2 and 4) over the major portion of their length. This lifting device 31 may also be moved back and forth in the direction of conveyance of pieces of material 10, 10', 10'' and so forth, in order to facilitate transfer of the pieces of material to the second conveyance device 27 without interruption, in other words "during operation" of the sewing station.

Figure 6:
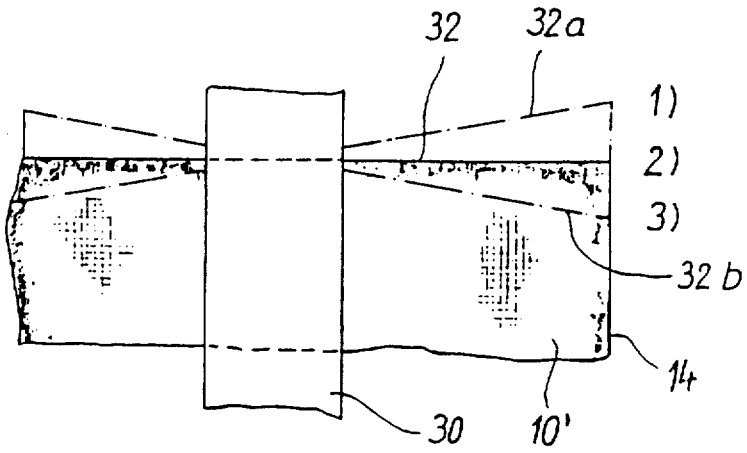
FIG. 6 shows a planar view of a part of a piece of material in the sewing station for illustration of the correct position as well as the oblique positions of the forward moving (front) edge of the piece of material in the area of the alignment device which itself is not shown in this case.
Figure 6A:
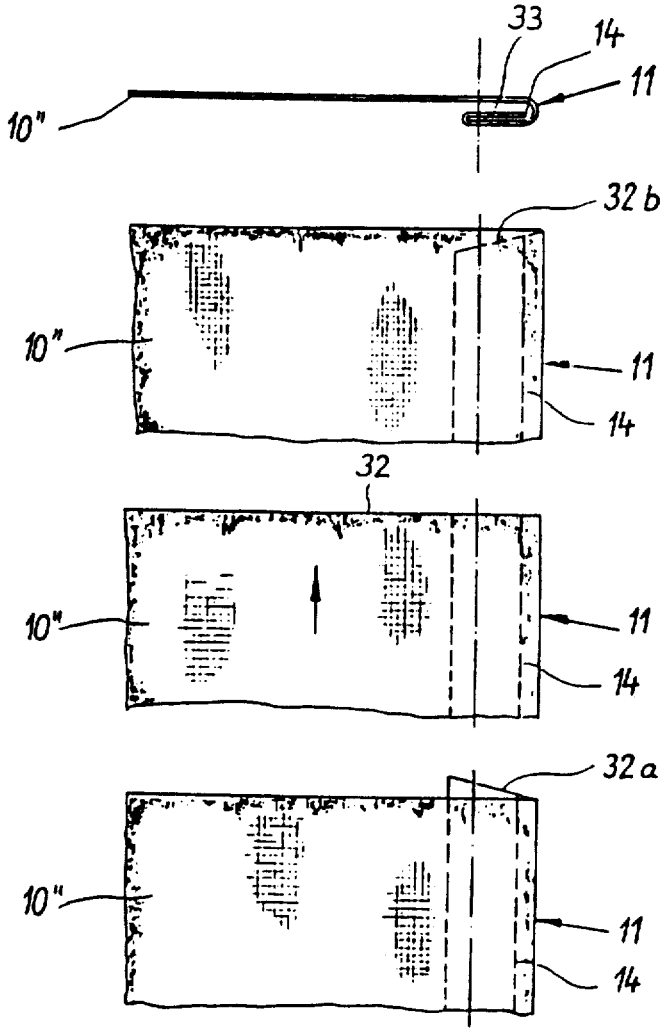
Figure 7:
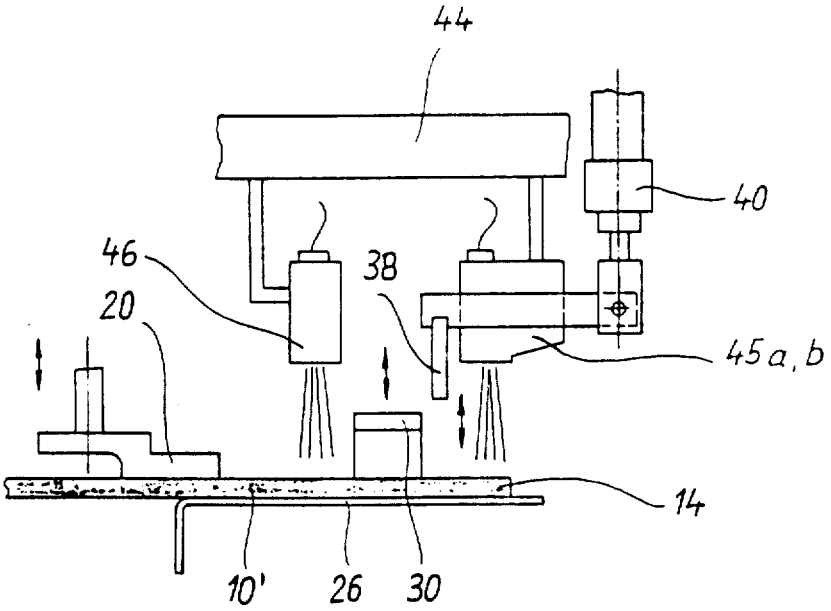
FIG. 7 shows a frontal view of a part of the first and second conveyance device and one half of the alignment device according to the invention during the guiding of a piece of material.

Reference is now to be made to FIGS. 1, 6 and 6A. The uncut piece of material 12 includes tensions of different origins. Following the separation of a piece of material 10 from uncut piece of material 12, the tension in a piece of material 10 is modified and can lead to oblique positioning of the same on mounting plates 26 which cannot be predicted or even foreseen beforehand. Thus the forward moving or front edge 32 of pieces of material 10, 10' also takes a corresponding oblique position (FIGS. 11 and 13), which must be corrected before pick-up of piece of material 10' by second conveyance device 27, since otherwise obstacle-free production of hem 11 on the cut edges 14 of pieces of material 10, 10' and so forth is not possible, as shown in FIGS. 6, 6A. When forward moving edge 32 of piece of material 10, 10' forms a right angle to the cut edge 14 and thus also to the direction of conveyance, as is shown in full line in FIG. 6, the middle point 33 of hem 11 is in flush alignment with forward moving edge 32 and a process of alignment is thus no longer necessary. However, as is shown in dot-dash lines at 32*a* and 32*b* in FIG. 6, when the forward moving edge of piece of material 10' has a one edge leading position or a one edge trailing position, without correction beforehand, then a withdrawn or a projecting middle point 33 occurs during formation of the hem, as is shown in FIG. 6A at 32*b* and 32*a*. In both cases the beginning and the end of hem 11 in the relevant piece of material 10'' are defective. Here then the invention is to be used and it executes an alignment of the piece of material 10', so that middle point 33 is flush with forward moving edge 32. An alignment device 34 is provided in the direction of conveyance of pieces of material 10, 10' for this purpose before folding devices 28 at the delivery point of a piece of material 10' from first conveyance device 17 to second conveyance device 27, which is to be described hereinafter.

Since in the exemplary embodiment both cut edges 14 of any piece of material 10'' are to be processed, in other words in this case are to be provided with a hem 11, it is necessary to align the forward moving edge 32 of piece of material 10' in the areas of both of the cut edges 14, particularly in case an oblique position or oblique angling of the same has been determined. Alignment device 34, therefore includes suitable means of correction in the areas of both of the facing cut edges 14 of piece of material 10', which means are arranged in the same manner and in mirror image to each other, so that it suffices to describe only one side of alignment device 34.

Arms 35 are fastened to the right side of guide rod 18 as shown in FIG. 1, and said arms in turn carry horizontal guides 36 for cartridges 37 on their free ends. Guides 36 run parallel to the direction of conveyance of pieces of material 10, 10', 10'' and so forth. Each carriage 37 carries an alignment strip 38 which can be raised and lowered, which likewise extends parallel to the direction of conveyance of pieces of material 10, 10', 10'' and so forth. In particular, each alignment strip 38 is guided by a guide rod 39 (FIG. 2) on carriage 37. A lifting cylinder 40 is also fastened to carriage 37, by means of which alignment strip 38 is raised or can be set on the piece of material 10' which is to be aligned. Alignment strip 38 is placed on piece of material 10' at a certain short distance from its cut edge 14.

Figure 2:
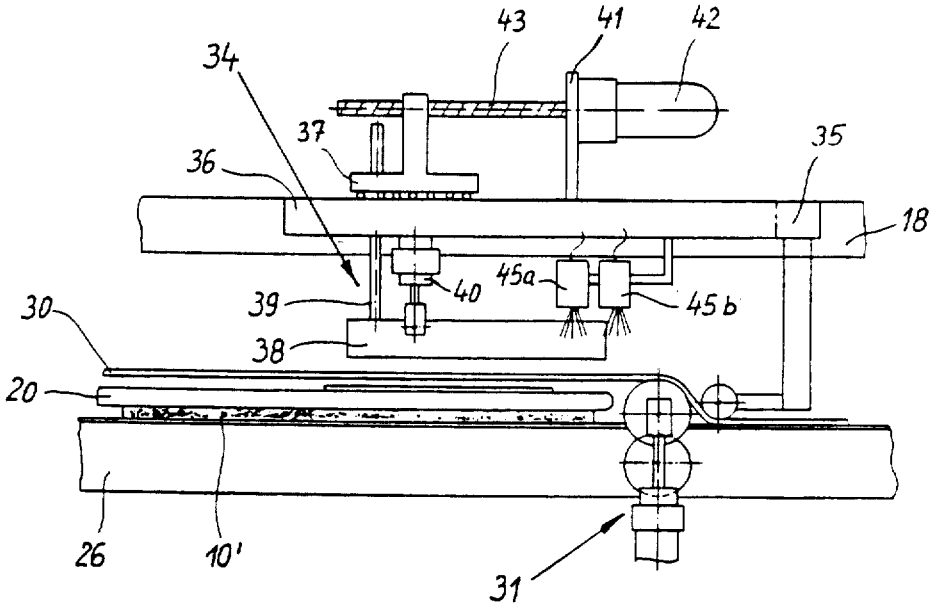
FIG. 2 shows a side view of a part of the sewing station shown in FIG. 1 in the area of the alignment device.
Figure 3:
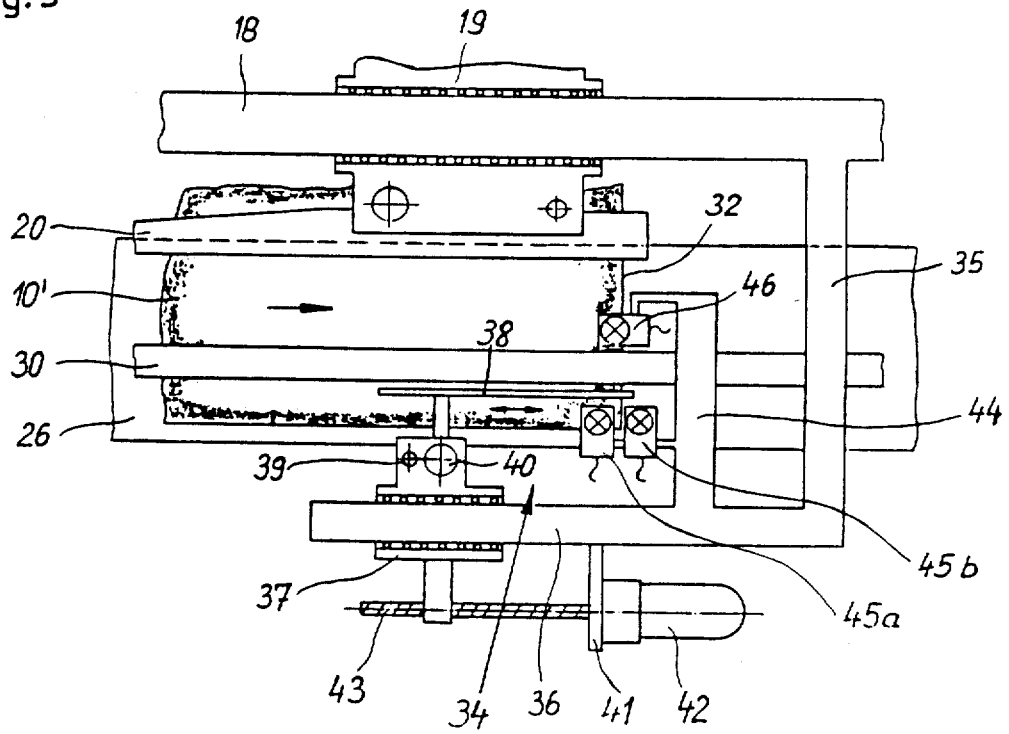
FIG. 3 shows a planar view of the part of the unit shown in FIG. 2, but with only one half of the alignment device according to the invention.

An outwardly cantilevered arm 41 is fastened by a bracket to each guide 36, and a power device 42 for adjusting the final control of the setting is flanged onto it. Power drive 42 for adjustment of the final control of the setting is connected through a drive shaft 43 with carriage 37, which according to the direction of rotation of drive shaft 43 is set in the direction of conveyance or counter to the direction of conveyance of pieces of material 10, 10', 10'' along guide 36. Alignment device 34 as shown in FIGS. 1-3 is laid out in such a manner that an alignment procedure can be carried out only when the piece of material 10' is at rest. This means that in the course of delivery of piece of material 10' from first conveyance device 17 to second conveyance device 27 for conveyance of the piece of material 10', a resting point occupies one short moment while the piece is on mounting plates 26. The material delivery is then discontinuous for a moment at this point.

An inwardly projecting arm 44 which incorporates three sensing elements 45*a*, 45*b* and 46, which are preferably photocells, is mounted on each guide 36. Sensing elements 45*a* and 45*b* are arranged at a certain spacing from one another in the direction of conveyance of pieces of material 10, 10', 10'' and by the results of their sensing of the forward moving or front edge of the piece of material they control power device 42 for adjustment of the final horizontal setting of alignment strip 38. Sensing element 46 controls lifting cylinder 40 of alignment strip 38. The method of operation of alignment device 34 as shown in FIGS. 1-3 will be further explained hereinafter in connection with FIGS. 7-13.

Figure 8:
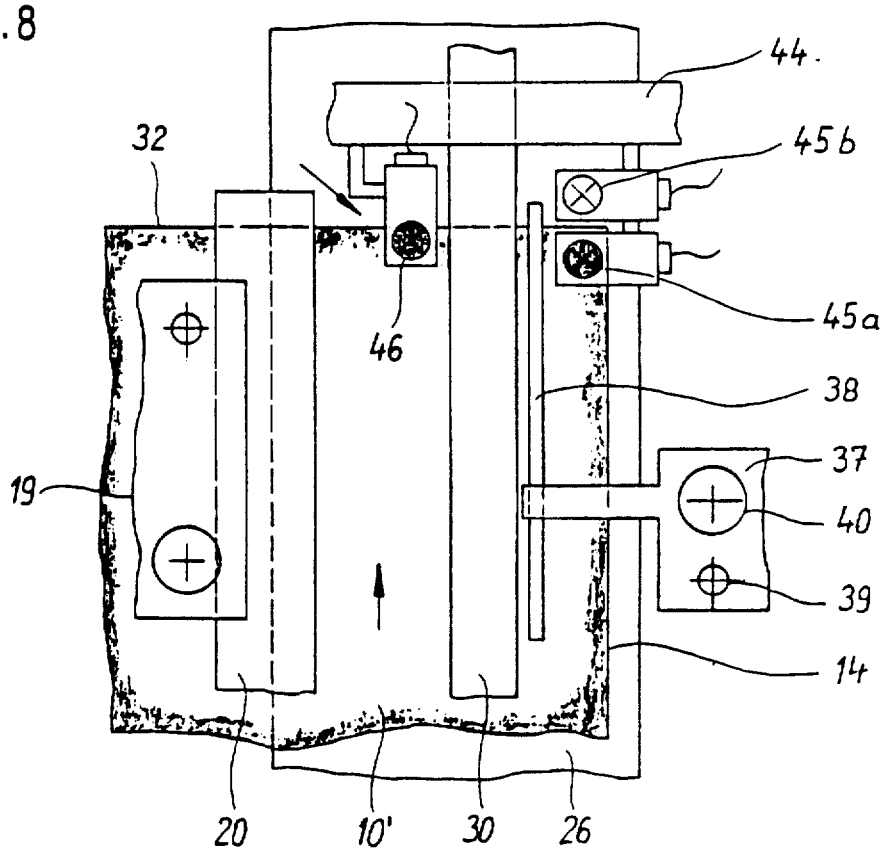
FIG. 8 shows a planar view of the same part of the assembly shown in FIG. 7, in which in this case the forward moving or front edge of a portion of a piece of material is shown in an optimum middle position.
Figure 9:
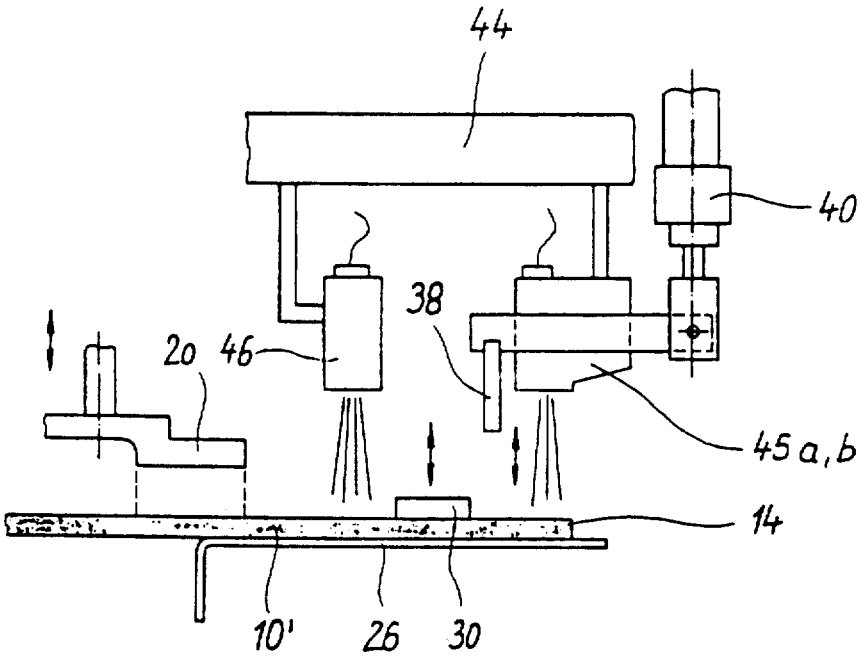
FIG. 9 shows a frontal view similar to that of FIG. 7, in which the first conveyance device has already been raised and the second conveyance device is activated.
Figure 10:
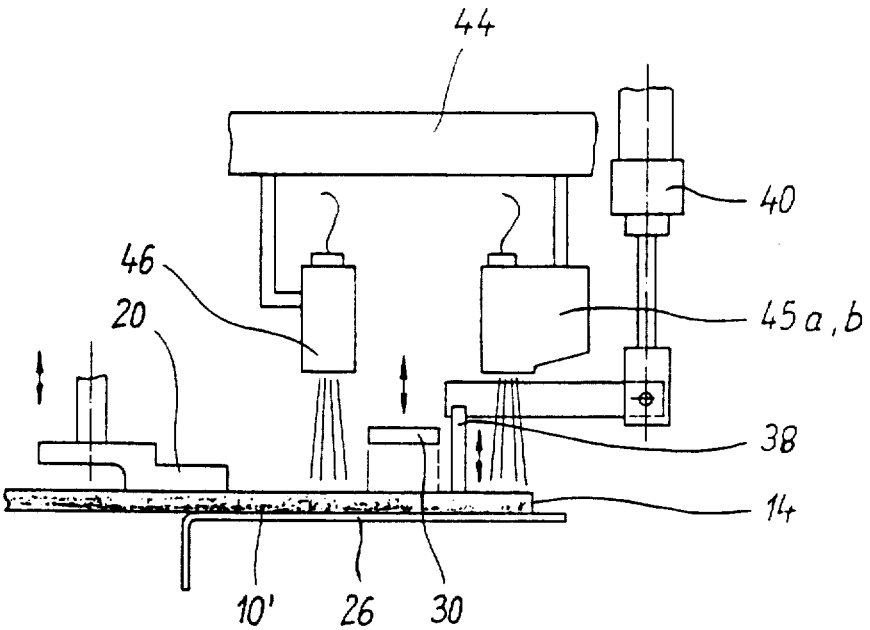
FIG. 10 shows a partial frontal view similar to that of FIG. 7, in which the alignment strip of the alignment device is lowered for the purpose of undertaking a correction of the alignment of the piece of material, while the second conveyance device is still raised.

When first conveyance device 17 of piece of material 10' moves into the delivery position shown in FIG. 1, sensing element 46 senses the arriving or forward moving edge 32 of piece of material 10' and produces a signal for lifting cylinder 40, which thereupon lowers alignment strip 38 and places it on piece of material 10'. The bottom fixtures of conveyor belts 30 of second conveyance device 27 are raised during this work phase of the sewing assembly (as shown in FIG. 2), so that the piece of fabric 10' can be moved from first conveyance device 17 to beneath second conveyance device 27. Now when the front or forward moving edge 32 of piece of material 10' occupies a correct position, in other words forms an angle of 90° with the cut edge 14 of piece of material 10', as shown in FIGS. 1, 3 and 8, only the one sensing element 45*a* is activated, while the other sensing element 45*b* remains out of operation. This alternating state of sensing elements 45*a* and 45*b* results in the condition wherein power drive 42 for adjustment of the final control of the setting remains disconnected and furthermore the raised bottom fixtures of conveyor belts 30 of second conveyance device 27 are lowered by a not shown control mechanism and are brought into position in contact with piece of material 10', in order to feed this piece of material to folding devices 28 with series-connected sewing machines 29, which form and stitch hems 11. While conveyor belts 30 are being lowered, piece of material 10' is affixed by alignment strips 38 in the area of its cut edges 14 and only following engagement of conveyor belts 30 with piece of material 10' are alignment strips 38 raised by lifting cylinder 40, as shown in FIG. 9.

Figure 11:
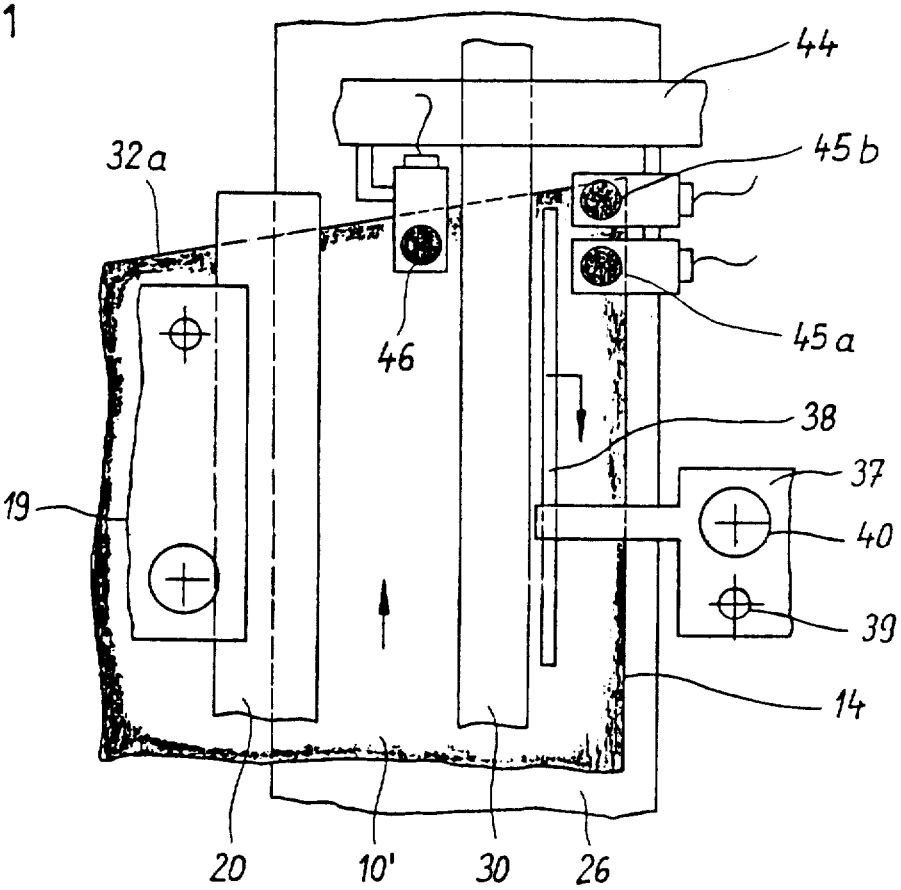
FIG. 11 shows a planar view of the arrangement shown in FIG. 10, in which the front or the forward moving edge of a piece of material takes an oblique position (one edge leading position), which is to be corrected.
Figure 12:
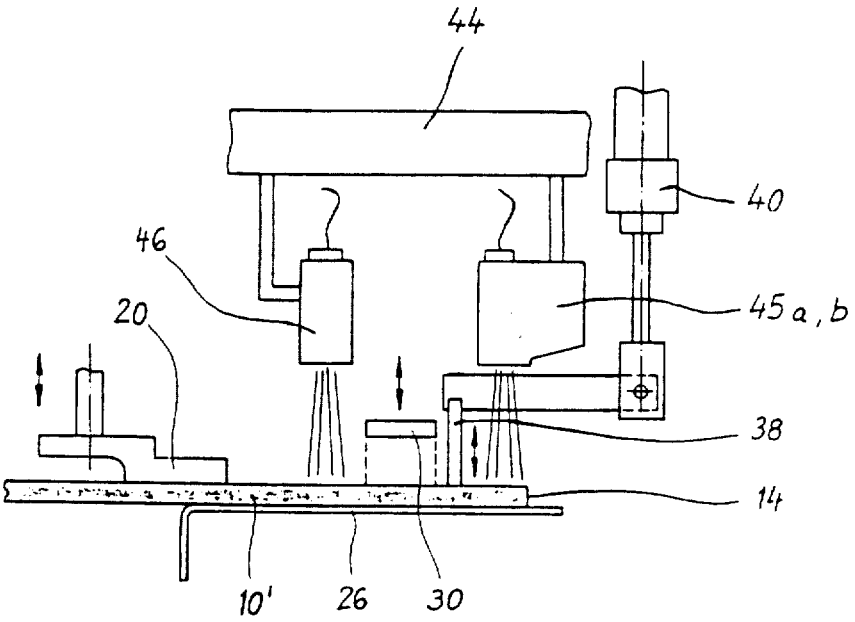
FIGS. 12 and 13 show a frontal and a planar view similar to those of FIGS. 10 and 11, in which in FIG. 13 the forward moving (front) edge of the piece of material is shown in one further possible oblique position (one edge trailing position), which makes a correction obligatory.

However, when the forward moving edge of piece of material 10' runs at a right angle to cut edge 14 and for instance is in a so-called one edge leading position, as shown in FIGS. 6 and 11 at 32*a*, both sensing elements 45*a* and 45*b* are then activated, which has as a result that alignment strip 38, lowered by lifting cylinder 40 and found in friction contact with piece of material 10', is moved for a sufficient distance in the direction of the arrow counter to the direction of conveyance of pieces of material 10, 10', 10'' until forward moving edge 32 in the area of cut edge 14 forms a right angle to the cut edge and thus sensing element 45*b* becomes inoperative. When this alignment procedure has been completed, the raised bottom fixtures of conveyor belts 30 of second conveyance device 27 are lowered to pick up the piece of material 10' which is being held by alignment strips 38 and carry it further in the direction of folding device 28 and sewing machines 29.

Figure 13:
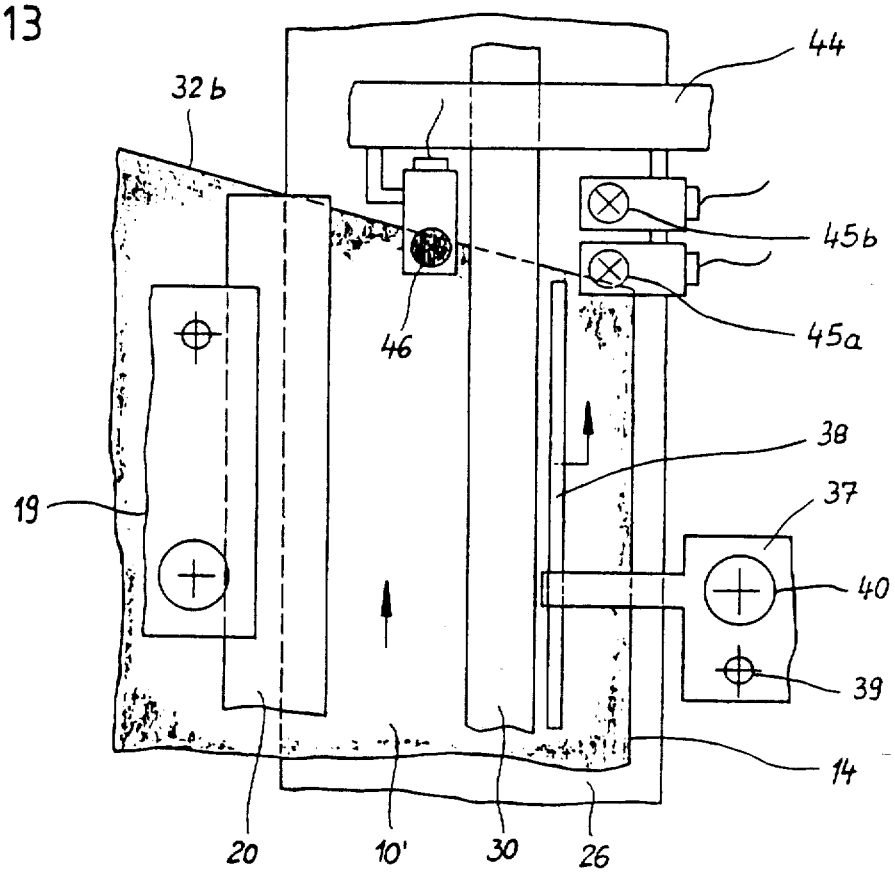

In FIGS. 6 and 13 the forward moving edge of piece of material 10' is shown in a one edge trailing position at 32*b*. In this case both sensing elements 45*a* and 45*b* remain inactive and cause power drive 42 for adjustment of the final control of the setting to be moved by means of drive shaft 43 and carriages 37 to move alignment strip 38 into friction contact with piece of material 10' for a certain distance in the direction of conveyance of pieces of material 10, 10' and so forth, until forward moving edge 32 of piece of material 10' forms a right angle with cut edge 14 and sensing element 45*a* is activated, while sensing element 45*b* remains inactive as it was before. When this state has been reached, the bottom fixtures of conveyor belts 30 of second conveyance device 27 are again lowered, in order to pick up piece of material 10' which is being held by alignment strips 38 and to carry it further. Alignment strips 38 are raised again by lifting cylinder 40 and moved back by power drive 42 into their original position shown in FIG. 1.

Figure 4:
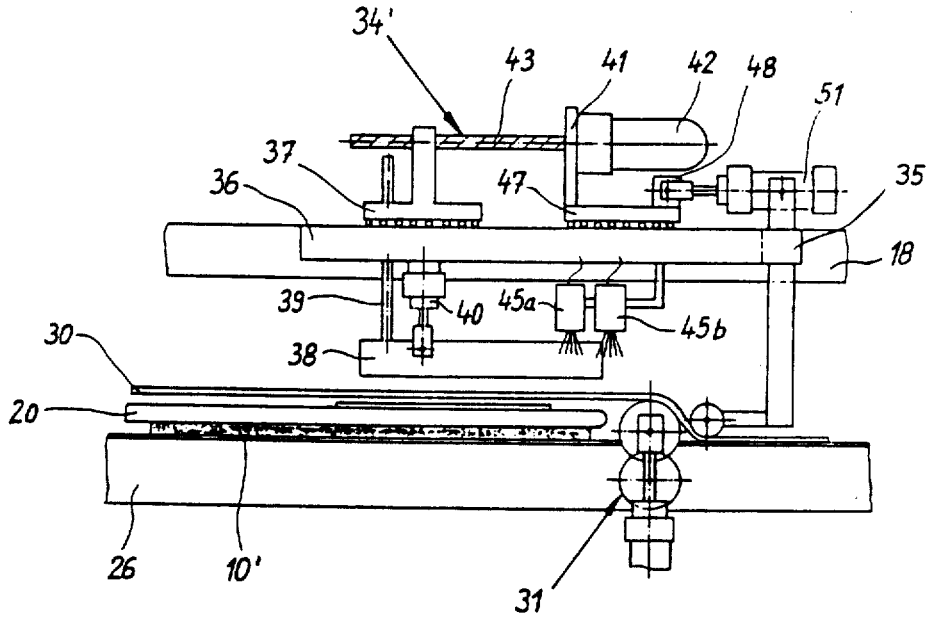
FIG. 4 shows a partial side view of the sewing station similar to that of FIG. 2 but in this case in the embodiment suitable for a continuous method of operation.
Figure 5:
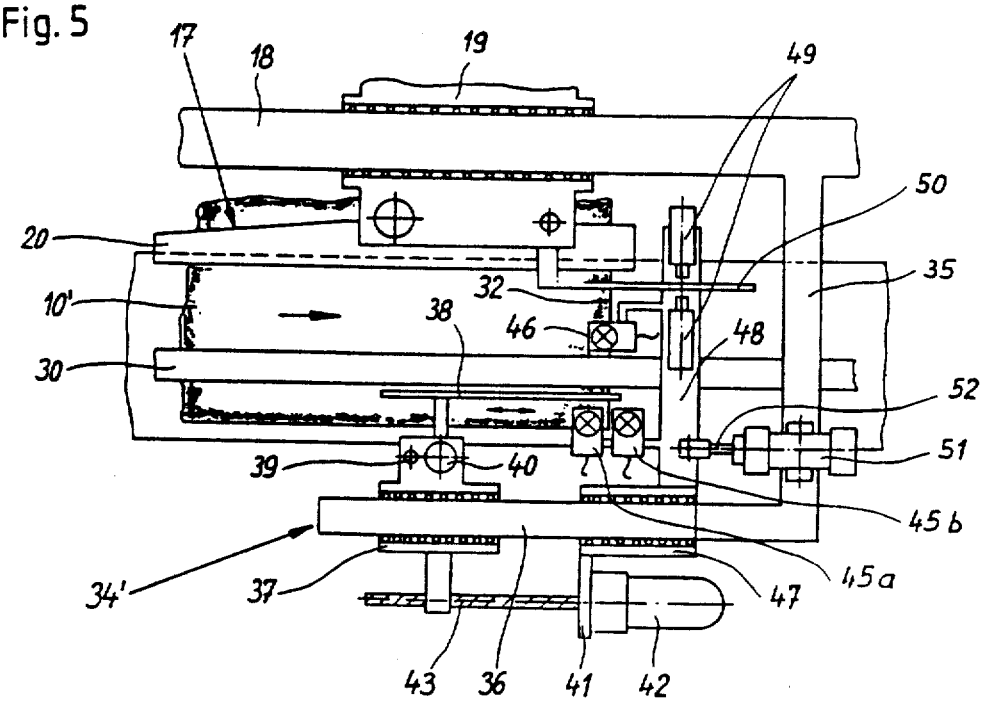
FIG. 5 shows a planar view of the arrangement shown in FIG. 4, including one half of the alignment device.

In the exemplary embodiment shown in FIGS. 4 and 5, alignment device 34' can be moved synchronously with first conveyance device 17 in the direction of conveyance of pieces of material 10, 10', 10'' and so forth during an alignment procedure. This means that the pieces of material 10' from first conveyance device 17 can be delivered continuously to second conveyance device 27, whereupon the high production rate of the sewing station is considerably increased. In this embodiment, power drive 42 for adjustment of the final control of the setting is fastened by means of arm 41 to a carriage 47, which is mounted in turn the same as carriage 37 on guide 36 and can be moved back and forth on said carriage. Carriage 47 incorporates another arm 48, on which are mounted sensing elements 45*a*, 45*b* and 46. Arm 48 furthermore carries a pneumatically or electromagnetically operable gripper coupling, which when it is in closed state cooperates with a gripper strip 50, mounted on carriage 19 of first conveyance device 17. Another operation cylinder 51 is fastened to stationary arm 35, of which the piston rod is connected through arm 48 with carriage 47. This operation cylinder 51 serves to guide the return movement of carriages 37 and 47 to their original positions. The method of operation of alignment device 34' is as follows:

When sensing element 46 detects the edge 32 of piece of material 10' as arriving or moving forward toward arrival, then gripper coupling 49 is closed, and carriages 47 and 37 are moved synchronously with first conveyance device 17 in the direction of conveyance of pieces of material 10, 10' and so forth. Alignment strip 38 is simultaneously lowered by lifting cylinder 40 and is brought into friction contact with piece of material 10'. In the case of a one edge leading position (32*a*) or a one edge trailing position (32*b*) in the case of the forward moving edge of piece of material 10', a suitable correction is accomplished by means of alignment strip 38, as has already been described in connection with FIGS. 10, 11 and 12, 13. To be sure, in this case the alignment takes place during the synchronous movement of alignment strips 38 with first conveyance device 17. Then when front edge 32 of piece of material 10' reaches its correct position, in other words, when one sensing element 45*a* is activated and the other sensing element 45*b* is inoperable, the raised bottom fixtures of conveyor belts 30 are lowered and brought into contact with the piece of material 10' which is still being held by alignment strips 38, in order to deliver the piece of material 10' to folding devices 28 and sewing machines 29. Then alignment strips 38 are raised by lifting cylinder 40 and carriages 47 and 37 are moved to the left into their original positions by operation cylinder 51 as shown in FIGS. 4 and 5.

What is claimed is:

1. In a sewing station for pieces of material incorporating processing stations, comprising a first conveyance device and a second conveyance device for the pieces of material, the first conveyance device serving to deliver said pieces of material from a source to the second conveyance device, a lifting device for lifting the second conveyance device for introduction of one of the said pieces of material and for lowering the second conveyance device so that the piece of material can be picked up and conveyed further to at least one processing station, the improvement wherein, in an area of the second conveyance device (27) and viewed from a direction of movement of the piece of material (10), there is provided an alignment device (34), means for moving said alignment device (34) vertically and horizontally in front of a processing station (28,29) for engagement with the piece of material (10) and for alignment of a front edge (32) of the piece of material (10), sensing elements (45,46) for sensing a position of the front edge (32) of the piece of material (10) and for controlling the alignment device so that it can be placed on the piece of material (10) and then can be shifted according to the position of a forward moving front edge (32) of the piece of material (10) in a direction of or counter to the direction of movement of the piece of material (10) to adjust its position before it is conveyed further to the processing station (28,29) by the second conveyance device (27).

2. Sewing station as in claim 1, wherein means are provided for moving the alignment device (34') synchronously with the first conveyance device (17) in the direction of movement of the piece of material (10).

3. Sewing station as in claim 1, wherein the alignment device (34) has at least one alignment strip (38) means for supporting said alignment strip so it is horizontally adjustable and can be placed on the piece of material (10) adjacent to one edge (14) processed and parallel to the direction of movement of the piece of material (10).

4. Sewing station as in claim 3, wherein means are provided to support the alignment strip (38) vertically movable on a first carriage (37) and raised and lowered by a lifting means (40), and that the first carriage (37) can be moved back and forth along a stationary horizontal guide (36) by means of a power device (42).

5. Sewing station as in claim 4, wherein the power device (42) is fastened to a second carriage (47), mounted on the stationary horizontal guide (36), and means are provided for moving the second carriage in the direction of movement of the piece of material (10) synchronously with the first conveyance device (17) for the piece of material (10).

6. Sewing station as in claim 5, wherein means are provided for coupling the second carriage (47) carrying the power device (42) with the first conveyance device (17) for the piece of material (10) for a synchronous movement of the second carriage (47) and the first conveyance device (17).

7. Sewing station as in claim 5 wherein the two carriages (47,37) carrying the power device (42) and the alignment strip (38) are mounted on the same stationary horizontal guide (36).

8. Sewing station as in claim 4, wherein the power device (42) for a horizontal adjustment of the alignment strip (38) is controlled by two sensing elements (45*a,b*) which are arranged over the direction of movement of the piece of material (10), as viewed from its direction of movement, at uniform spacing from one another.

9. Sewing station as in claim 8, wherein the two sensing elements (45*a,b*) controlling the power device (42) for horizontal adjustment of the alignment strip (38) are fastened to the second carriage (47) carrying the power device (42).

10. Sewing station as in claim 5, wherein an additional sensing element (46) controlling an attachment of the second carriage (47) carrying the power device (42) to the first conveyance device (17) and also a lowering of the alignment strip (38), is fastened to the second carriage (47).

* * * * *